US009092959B2

(12) United States Patent
Kim et al.

(10) Patent No.: US 9,092,959 B2
(45) Date of Patent: Jul. 28, 2015

(54) COMPOSITE TEMPERATURE AND SMOKE ALARM DEVICE AND EQUIPPED SMOKE SENSOR THEREIN

(75) Inventors: Hyun-Tak Kim, Daejeon (KR); Bongjun Kim, Daejeon (KR); Jong Chan Park, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 13/824,956

(22) PCT Filed: Jun. 7, 2012

(86) PCT No.: PCT/KR2012/004500
§ 371 (c)(1),
(2), (4) Date: Mar. 18, 2013

(87) PCT Pub. No.: WO2012/169802
PCT Pub. Date: Dec. 13, 2012

(65) Prior Publication Data

US 2014/0111343 A1 Apr. 24, 2014

(30) Foreign Application Priority Data

Jun. 8, 2011 (KR) ..... 10-2011-0055312
Dec. 20, 2011 (KR) ..... 10-2011-0138355

(51) Int. Cl.
*G08B 17/10* (2006.01)
*G08B 17/06* (2006.01)

(52) U.S. Cl.
CPC ..... *G08B 17/10* (2013.01); *G08B 17/06* (2013.01)

(58) Field of Classification Search
CPC .... G08B 19/005; G08B 29/145; G08B 17/10; G08B 17/06
USPC ..... 340/628, 632, 629, 630, 633, 634, 340/693.6
See application file for complete search history.

(56) References Cited

U.S. PATENT DOCUMENTS 6,426,703 B1 * 7/2002 Johnston et al. ..... 340/628
6,696,939 B2 * 2/2004 Schneider et al. ..... 340/500

(Continued)

FOREIGN PATENT DOCUMENTS

JP 1990-38754 U 3/1990
JP 2000-215361 A 8/2000

(Continued)

OTHER PUBLICATIONS

Hyun-Tak Kim, et al., "Mechanism and observation of Mott transition in $VO_2$-based two- and three-terminal devices", New Journal of Physics, May 17, 2004, pp. 1-19, vol. 6, No. 52.

(Continued)

*Primary Examiner* — Toan N Pham

(57) ABSTRACT

Disclosed is a multipurpose alarm apparatus which includes a smoke sensing unit configured to sense a smoke using a first sensor and a second sensor, each of the first and second sensors including a temperature-sensitive smoke sensor portion disposed between a first electrode and a second electrode; a smoke level measuring unit configured to generate a smoke level measurement signal by comparing a difference between first and second smoke detection signals from the first and second sensors with a reference signal; and a sensing control unit configured to generate a fire alarm signal when the smoke level measurement signal corresponds to a fire generation condition.

29 Claims, 16 Drawing Sheets

(56) References Cited

U.S. PATENT DOCUMENTS

| | | | |
|---|---|---|---|
| 7,944,360 | B2 | 5/2011 | Kim et al. |
| 8,207,750 | B2 | 6/2012 | Kim et al. |
| 8,305,221 | B2 | 11/2012 | Kim et al. |

FOREIGN PATENT DOCUMENTS

| | | | |
|---|---|---|---|
| KR | 10-0744551 | B1 | 8/2007 |
| KR | 10-2007-0115571 | A | 12/2007 |
| KR | 10-2008-0013670 | A | 2/2008 |

OTHER PUBLICATIONS

E. Arcangeletti, et al., "Evidence of a Pressure-Induced Metallization Process in Monoclinic $VO_2$", Physical Review Letters, May 11, 2007, pp. 196406-1~4, vol. 98.

International Search Report for PCT/KR2012/004500 filed Jun. 7, 2012.

* cited by examiner

Fig. 1A [PRIOR ART]
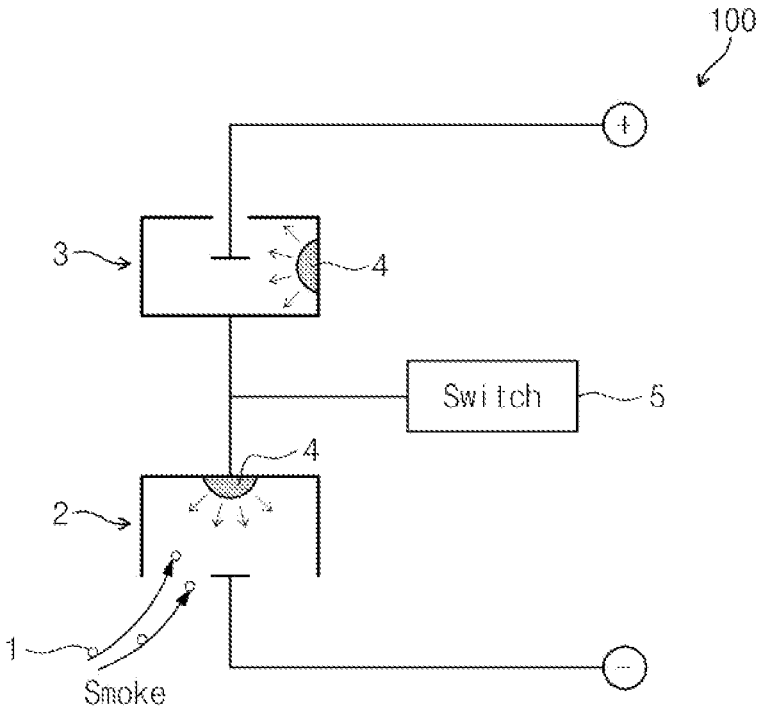
Fig. 1B [PRIOR ART]
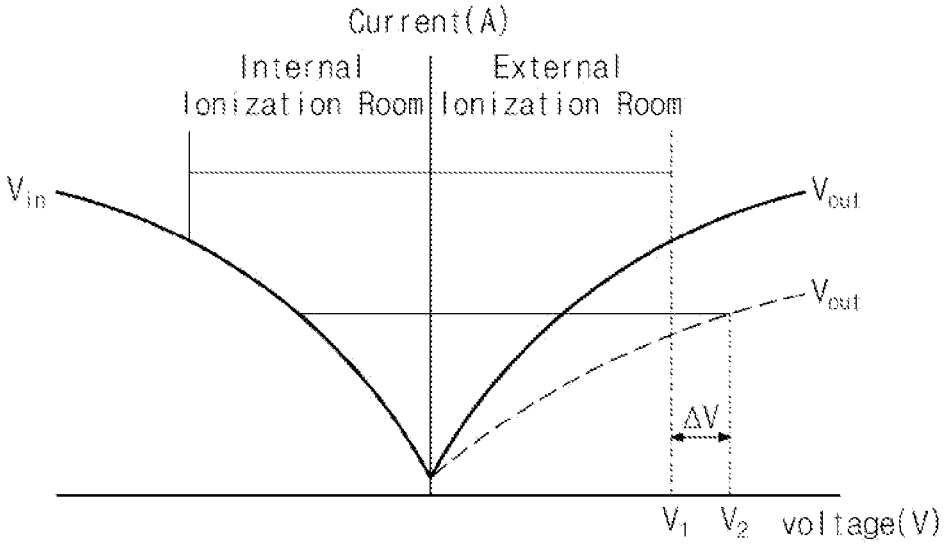

Fig. 2 [PRIOR ART]
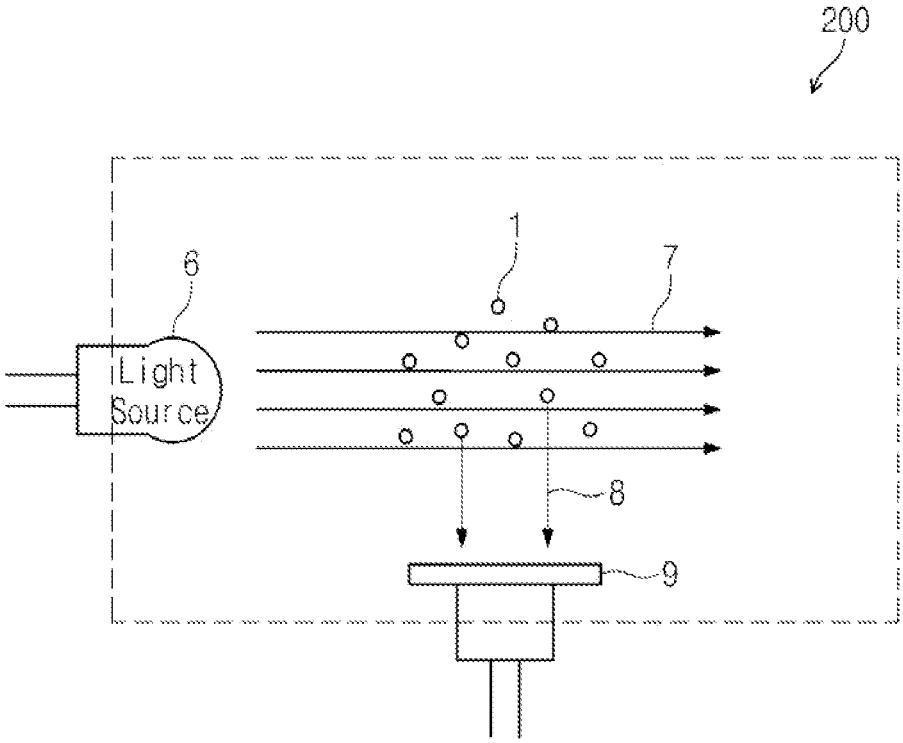

COMPOSITE TEMPERATURE AND SMOKE ALARM DEVICE AND EQUIPPED SMOKE SENSOR THEREIN

TECHNICAL FIELD

The inventive concepts described herein relate to an alarm apparatus, and more particularly, relate to a multipurpose alarm apparatus and a smoke sensor thereof.

BACKGROUND ART

Fire may be detected by detecting a temperature higher than a room temperature and detecting smoke. As well known in the art, a temperature detector may be designed according to a differential manner in which a variation in a temperature is sensed or according to a fixed temperature manner in which a specific temperature is sensed. A smoke detector may be designed according to an ionization manner in which ionized smoke is sensed or according to an optical manner in which light scattered due to collision of light, particles, and smoke is sensed.

FIG. 1A is a conceptual diagram schematically illustrating an ionization type smoke detector. FIG. 1B is a graph illustrating a voltage variation of an output of a smoke detector in FIG. 1A.

Referring to FIGS. 1A and 1B, a conventional ionization type smoke detector 100 may include an external ionization room 2 exposed to smoke particles 1 and an internal ionization room 3 providing a space independent from the exterior. Each of the external ionization room 2 and the internal ionization room may include a radiation source 4. The radiation sources 4 may include radiation materials (e.g., americium-241 (Am-241), radium (Ra), etc.) emitting radiation for ionizing the smoke particles 1. A switch 5 may control voltages to be applied to the external and internal ionization rooms 2 and 3 in various manners. When the smoke particles 1 don't exit at the external ionization room 2, an internal voltage Vin and an external voltage Vout may become symmetric to be identical to each other. On the other hand, a difference ΔV of external voltages Vout may be generated when the smoke particles 1 do exit at the external ionization room 2. At this time, the external voltage Vout may be lower than the internal voltage Vin. However, the conventional ionization-type smoke detector 100 may necessitate a smoke ionizing process using a harmful radiation material. That is, the conventional ionization-type smoke detector 100 may have problems of the safety.

FIG. 2 is a conceptual diagram schematically illustrating a conventional optical-type smoke detector.

Referring to FIG. 2, an optical-type smoke detector 200 may include an optical sensor 9 which is configured to sense scattered light 8. Herein, the scattered light 8 may be generated when light output from a light source 6 is scattered by smoke particles 1. The optical sensor 9 may be installed at a closed place to have a space independent from the outside. The independent space for installation of the optical sensor 9 may cause an increase in an installation cost. Also, the conventional optical-type smoke detector 200 may necessitate a high-performance optical sensor 9 for sensing the scattered light 8. That is, the productivity of the optical-type smoke detector 200 may be low.

DISCLOSURE OF INVENTION

Example embodiments of the inventive concept provide a multipurpose alarm apparatus comprising a smoke sensing unit configured to sense a smoke using a first sensor and a second sensor, each of the first and second sensors including a temperature-sensitive smoke sensor portion disposed between a first electrode and a second electrode; a smoke level measuring unit configured to generate a smoke level measurement signal by comparing a difference between first and second smoke detection signals from the first and second sensors with a reference signal; and a sensing control unit configured to generate a fire alarm signal when the smoke level measurement signal corresponds to a fire generation condition.

In example embodiments, the temperature-sensitive smoke sensor portion includes a metal-insulator transition material.

In example embodiments, the first sensor include a can type package having an opening hole formed to expose the temperature-sensitive smoke sensor portion to the smoke.

In example embodiments, the second sensor includes a mold type package configured to seal the temperature-sensitive smoke sensor portion.

In example embodiments, the smoke level measuring unit includes a differential amplifier configured to amplify a difference between the first smoke detection signal and the second smoke detection signal.

In example embodiments, the differential amplifier is a current mirror type or a cross coupled type.

Example embodiments of the inventive concept also provide a multipurpose alarm apparatus comprising a smoke sensing unit including a sensor having a temperature-sensitive smoke sensor portion disposed between a first electrode and a second electrode; and a micro control unit configured to generate a fire alarm signal using a smoke detection signal output from the sensor to output the fire alarm signal to an external device.

In example embodiments, the temperature-sensitive smoke sensor portion includes a metal-insulator transition material having a resistance value that decreases according to an increase in a temperature.

In example embodiments, the metal-insulator transition material includes vanadium oxide.

In example embodiments, the sensor an NPN or PNP bipolar transistor having a collector and an emitter corresponding to the first electrode and the second electrode, respectively.

In example embodiments, the sensor includes a cap type package having an opening hole formed to expose the temperature-sensitive smoke sensor portion.

In example embodiments, the sensor includes a mold type package formed to seal the temperature-sensitive smoke sensor portion.

In example embodiments, the mold type package includes a clear compound not chemically reacting to the temperature-sensitive smoke sensor portion.

In example embodiments, the multipurpose alarm apparatus further comprises a power supply voltage supplying unit configured to supply a power supply voltage to the smoke sensing unit and the micro control unit.

In example embodiments, the multipurpose alarm apparatus further comprises an input/output interface connected between the smoke sensing unit and the micro control unit.

In example embodiments, the smoke sensing unit is configured to vary a detection output level of a voltage drop output terminal connected to a sensor input bias using an output of the sensor.

In example embodiments, the smoke sensing unit includes a resistor connected between the sensor input bias and the voltage drop output terminal.

In example embodiments, the smoke sensing unit comprises a first transistor connected between the voltage drop output terminal and an output terminal of the sensor.

In example embodiments, the smoke sensing unit is configured such that an output level of the sensor corresponds to a detection output level and an output level of the sensor is adjusted responsive to an input of the input/output interface.

In example embodiments, the smoke sensing unit includes a second transistor connected between the output terminal of the sensor and a ground and controlled by an input of the input/output interface.

In example embodiments, the smoke sensing unit is configured such that a detection output level of a voltage drop output terminal connected to a sensor input bias is dependent upon a sensitivity of a sensing operation of the sensor.

In example embodiments, the power supply voltage supplying unit includes a zener diode for lowering a voltage to a required voltage of the micro control unit.

In example embodiments, the power supply voltage supplying unit further comprises a bridge diode circuit.

In example embodiments, the power supply voltage supplying unit includes a thyristor or a thyristor equivalent circuit for keeping a current controlled by the micro control unit.

In example embodiments, the micro control unit further comprises a communication unit transmitting the fire alarm signal to an external device.

In example embodiments, the communication unit includes at least one of a base station, a repeater, or a router.

In example embodiments, the communication unit further comprises a handheld terminal.

In example embodiments, the smoke sensing unit detects an electromagnetic wave of an infrared ray.

In example embodiments, the smoke sensing unit detects a temperature of a power element of a power system.

In example embodiments, the micro control unit controls a heat of the power element.

EFFECT OF INVENTION

Since a temperature-sensitive smoke sensor portion of a sharp metal-insulator material such as vanadium oxide is used as an active portion, it is possible to improve the safety and productivity. Also, a smoke sensor including a low-cost temperature-sensitive smoke sensor portion may improve the productivity.

BRIEF DESCRIPTION OF DRAWINGS

Preferred embodiments of the inventive concept will be described below in more detail with reference to the accompanying drawings. The embodiments of the inventive concept may, however, be embodied in different forms and should not be constructed as limited to the embodiments set forth herein. Rather, these embodiments are provided so that this disclosure will be thorough and complete, and will fully convey the scope of the inventive concept to those skilled in the art. Like numbers refer to like elements throughout.

FIG. 1A is a conceptual diagram schematically illustrating an ionization-type smoke detector.

FIG. 1B is a graph illustrating a voltage variation of an output of a smoke detector in FIG. 1A.

FIG. 2 is a conceptual diagram schematically illustrating a conventional optical-type smoke detector.

BEST MODE FOR CARRYING OUT THE INVENTION

Figure 3:
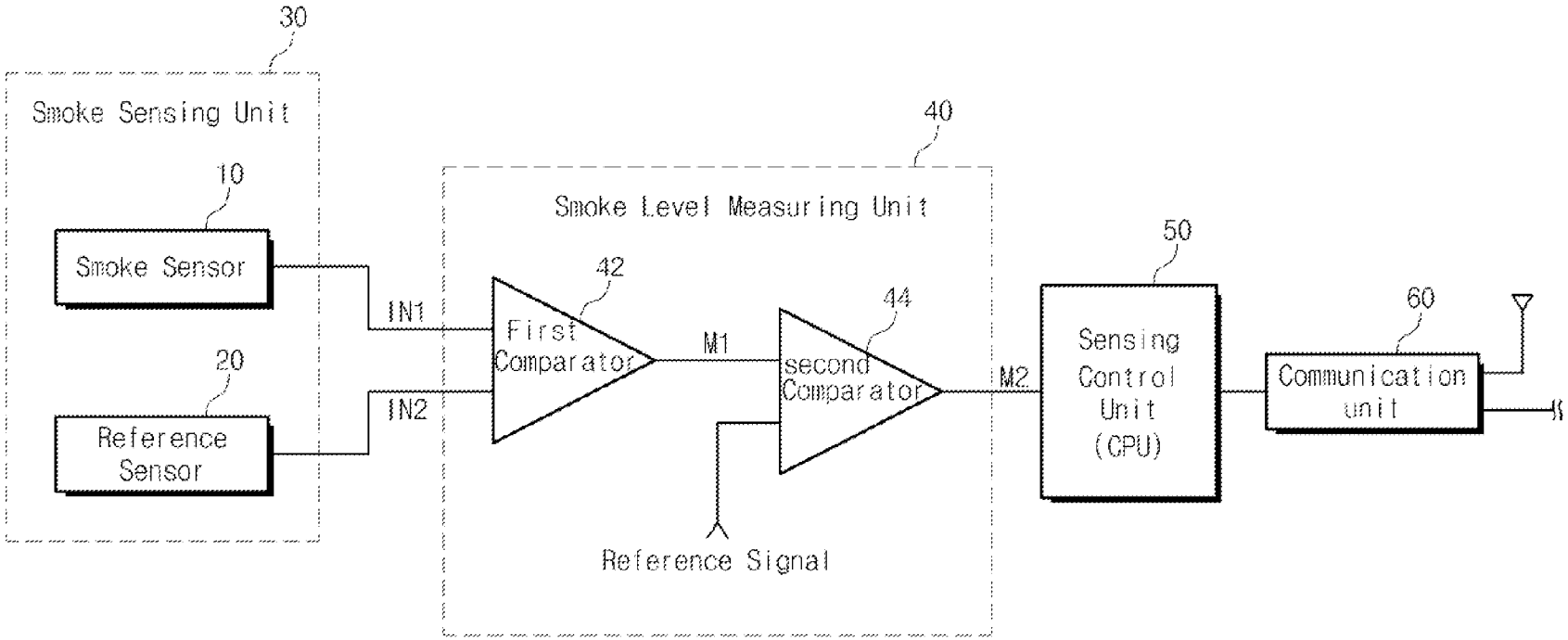
FIG. 3 is a block diagram schematically illustrating a multipurpose alarm apparatus according to an embodiment of the inventive concept.

Embodiments of inventive concepts will be described more fully hereinafter with reference to the accompanying drawings, in which embodiments of the invention are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present.

Figure 4:
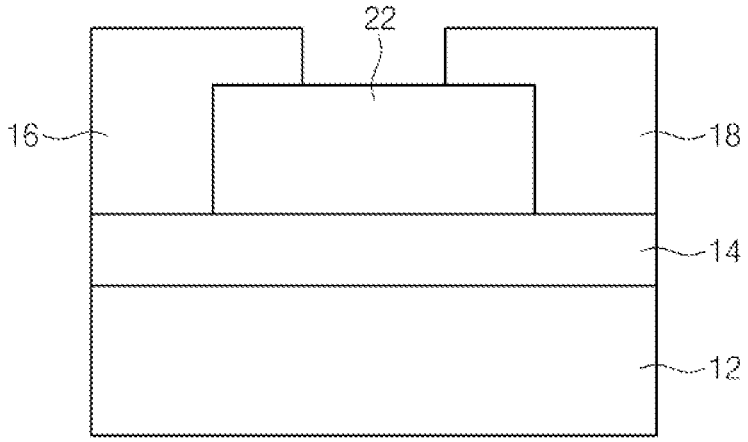
FIG. 4 is a cross-sectional view illustrating a stack structure of a smoke sensor and a reference sensor.

FIG. 3 is a block diagram schematically illustrating a multipurpose alarm apparatus according to an embodiment of the inventive concept. FIG. 4 is a cross-sectional view illustrating a stack structure of a smoke sensor 10 and a reference sensor 20. In example embodiments, a multipurpose alarm apparatus according to an embodiment of the inventive concept may be also referred to as a complex alarm apparatus capable of alarming both temperature and smoke.

Referring to FIGS. 3 and 4, a multipurpose alarm apparatus according to an embodiment of the inventive concept may include a smoke sensor 10 and a reference sensor 20 each having a temperature-sensitive smoke sensor portion 22 which is formed between a first electrode 16 and a second electrode 18 spaced apart. The temperature-sensitive smoke sensor portion 22 may be disposed on a substrate 12 or a buffer portion 14. The temperature-sensitive smoke sensor portion 22 may include a metal-insulator transition material the resistance of which is varied at a predetermined temperature. For example, the metal-insulator transition material may include vanadium oxide. Resistance of the vanadium oxide may sharply decrease when a temperature varies at a room temperature. The metal-insulator transition material is minimized leakage current in standby mode.

Thus, the multipurpose alarm apparatus according to an embodiment of the inventive concept may improve or maximize the safety and productivity.

When the fire breaks at a closed space, convective activity may arise due to rising of heated air. Also, there may be generated high-temperature smoke, including carbon dioxide and aqueous vapor, generated when objects are burned. Also, the pressure may become high by volume expansion due to air heated within a closed space during fires. The metal-insulator transition material may become a nonconductor such as insulator below a critical temperature and a conductor such as metal over the critical temperature. When the pressure become high, resistance of the metal-insulator transition material may decrease, while conductivity of the metal-insulator transition material may increase.

Figure 5:
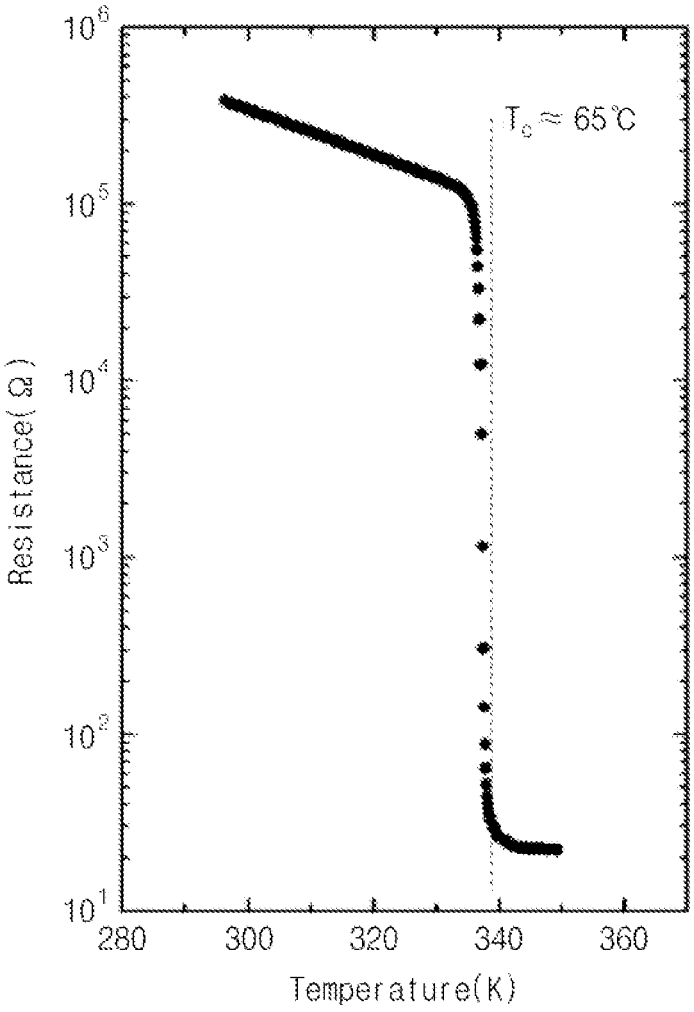
FIG. 5 is a graph illustrating a variation in a resistance value of vanadium oxide according to a temperature variation.

FIG. 5 is a graph illustrating a variation in a resistance value of vanadium oxide according to a temperature variation.

Referring to FIG. 5, a resistance value of vanadium oxide may decrease exponentially according to a temperature. In FIG. 5, a horizontal axis may indicate a temperature, and a vertical axis may indicate a resistance value. For example, a resistance value of vanadium oxide may decrease exponentially at 65° C. (338K).

Figure 6:
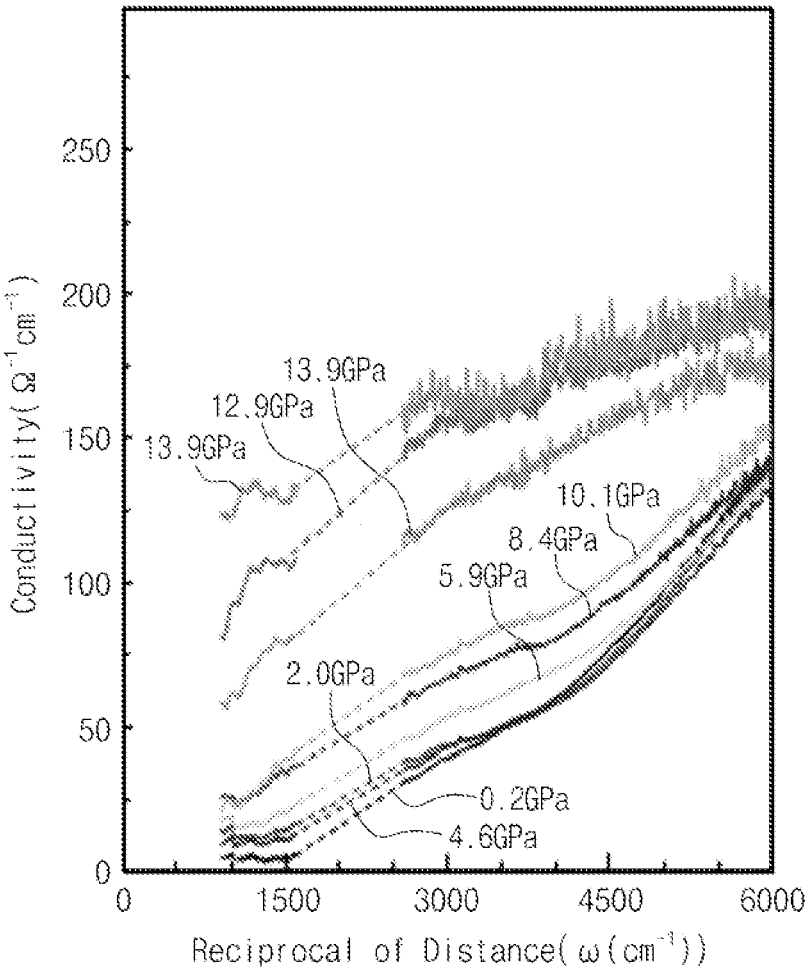
FIG. 6 is a graph illustrating the conductivity of vanadium oxide according to a pressure variation.

FIG. 6 is a graph illustrating the conductivity of vanadium oxide according to a pressure variation.

Referring to FIG. 6, conductivity of vanadium oxide may increase according to an increase in a pressure. Herein, a horizontal axis may indicate a frequency of an electromagnetic wave corresponding to a bias energy, and a vertical axis may indicate the conductivity. The conductivity of vanadium oxide ma gradually increase from 0 to 200 $\Omega^{-1}cm^{-1}$ when the pressure sequentially increases in this order of 0.2 GPa, 2.0 GPa, 4.6 GPa, 5.9 GPa, 8.4 GPa, 10.1 GPa, 11.9 GPa, and 13.9 GPa. The conductivity may increase in proportion to a frequency of an electromagnetic wave. Thus, a temperature-sensitive smoke detector portion 22 may include vanadium oxide that has resistance decreasing according to the temperature and pressure and conductivity increasing according to the temperature and pressure.

A metal-insulator transition material may include a compound semiconductor such as p-type Si added a low concentration of holes, Ge, Al, As, Sb, B, N, Ga, P, In, Te, Ag, Cd, Zn, Pb, S, Bi, K, H, Be, O, or C. The metal-insulator transition material may also include a oxide semiconductor added a low concentration of holes such as Y, Pr, Ba, Cu, La, Sr, Ti, V, Ca, Fe, W, Mo, Nb, Al, Hf, Ta, Zr, La, or Pd The metal-insulator transition material may also include semiconductor added a low concentration of holes such as Fe, S, Sm, Se, Te, Eu, Si, Mn, Co, B, H, Li, Ca, Y, Ru, Os, P, As, P, Ir, Ti, Zr, Hf, Mo, Te, Tc, Re, Rh, Pt, Yb, Ce, Pr, Nd, Pm, Sm, Eu, Gd, Tb, Dy, Ho, Er, Tm, Lu, or O, elements of C, rare earth, or lanthanide. A substrate 12 may include single crystal silicon or sapphires. A buffer portion 14 may be disposed between the substrate 12 formed of single crystal silicon and a temperature-sensitive smoke detector portion 22 formed of the metal-insulator transition material. The buffer portion 14 can include SiO2, SiN, SiON, and the like.

Figure 7:
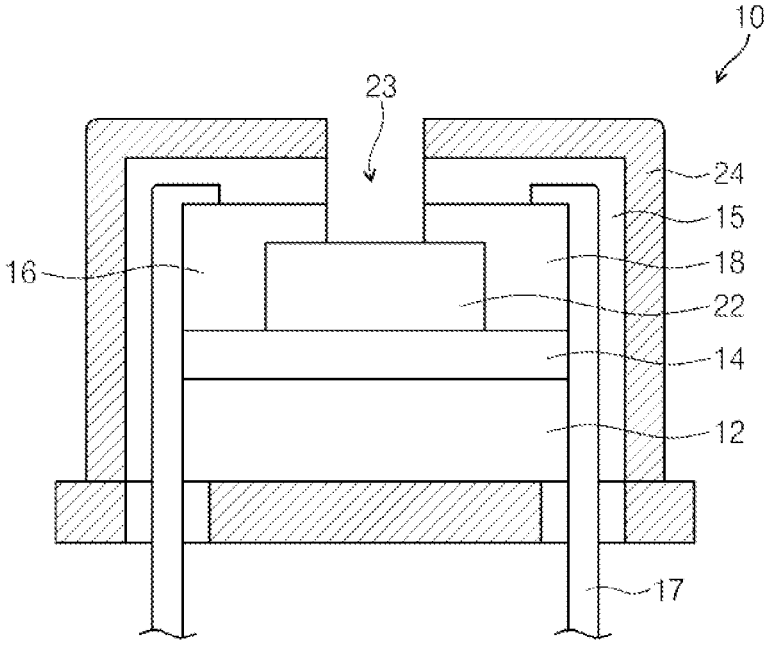
FIGS. 7 and 8 are cross-sectional views of smoke and reference sensors in FIG. 3.
Figure 8:
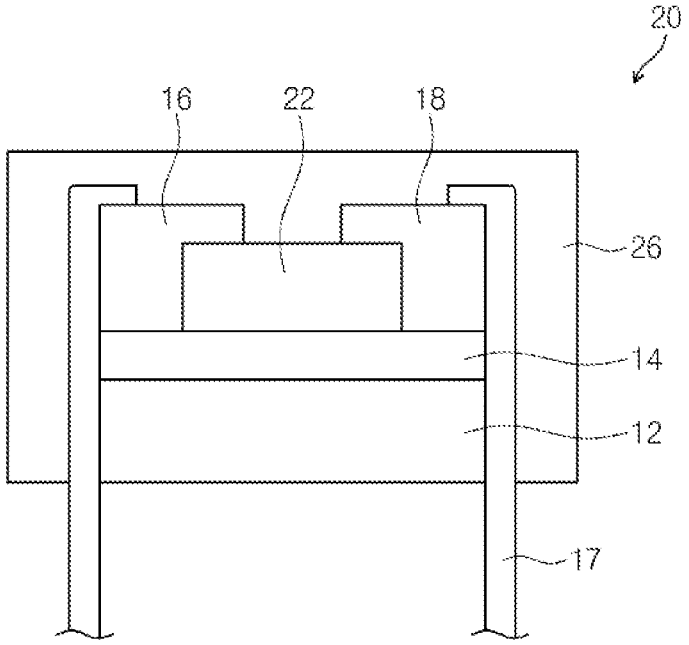

FIGS. 7 and 8 are cross-sectional views of smoke and reference sensors in FIG. 3.

Referring to FIGS. 3, 7, and 8, a smoke sensor 10 may include a can type package 24 which has an opening hole 23 formed such that a temperature-sensitive smoke sensor portion 22 contacting with smoke particles is exposed to the outside. In the can type package 24, leads 17 may be connected with first and second electrodes 16 and 18 and extended in an opposite direction to the opening hole 23. As illustrated in FIG. 7, the leads 17 may be extended to the outside of the can type package 24. The can type package 24 may be isolated from the first and second electrodes 16 and 18 and the leads 17 by a filling material 15. The can type package 24 may seal a substrate 12 and a buffer portion 14. The smoke sensor 10 may be disposed within a smoke box.

The reference sensor 20 may include a mold type package 26 which is configured to seal the temperature-sensitive smoke detector portion 22. The mold type package 26 may seal the temperature-sensitive smoke detector portion 22 of the reference sensor 20. At this time, the mold type package 26 may contact with the temperature-sensitive smoke detector portion 22. The mold type package 26 may include polymer or a clear compound of a barrier portion not chemically reacting to the temperature-sensitive smoke detector portion 22. The leads 17 may be connected with the first and second electrodes 16 and 18 within the mode type package 26. Also, the leads 17 may be extended to the inside and outside of the mode type package 26. When disposed within the same space as the smoke sensor 10, the reference sensor 20 may compensate for a voltage difference corresponding to a temperature difference between the sensors 10 and 20. The smoke and reference sensors 10 and 20 may form a smoke sensing unit 30.

Figure 9:
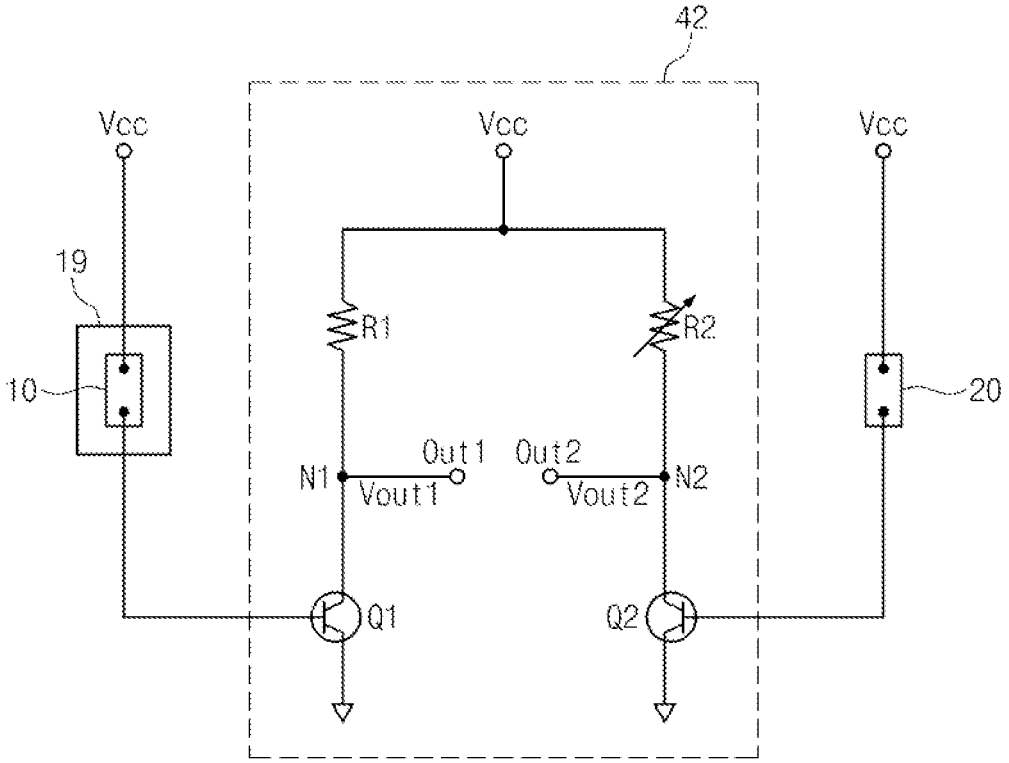
FIGS. 9 and 10 are circuit diagrams illustrating a first comparator of a smoke level measuring unit in FIG. 3.
Figure 10:
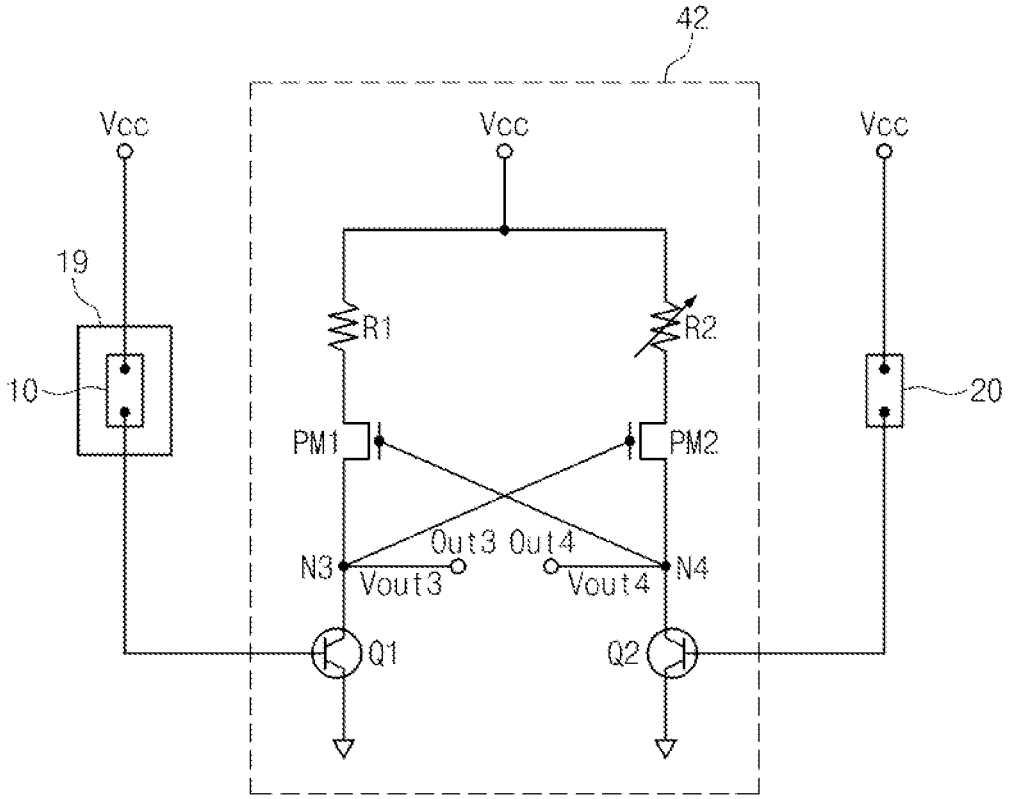

FIGS. 9 and 10 are circuit diagrams illustrating a first comparator of a smoke level measuring unit in FIG. 3.

Referring to FIGS. 3 and 9, a smoke level measuring unit 40 may receive first and second smoke detection signals IN1 and IN2 of a smoke sensing unit 30 to generate first and second smoke level measurement signals M1 and M2. The smoke level measuring unit 40 may include a first comparator 42 and a second comparator 44. The first comparator 42 may obtain a voltage difference between the first smoke detection signal IN1 from a smoke sensor 10 and the second smoke detection signal IN2 from a reference sensor 20. The first comparator 42 may provide the second comparator 44 or a sensing control unit 50 with whether smoke exists at the smoke sensor 10. The first comparator 42 may include a differential amplifier. The differential amplifier may be a current mirror type or a cross-coupled type.

A current mirror type differential amplifier (refer to FIG. 9) may include first and second bipolar transistors Q1 and Q2 and first and second resistors R1 and R2. The smoke sensor 10 may be connected to a base of the first bipolar transistor Q1. The reference sensor 20 may be connected to a base of the second bipolar transistor Q2. Collectors of the first and second bipolar transistors Q1 and Q2 may be grounded, and emitters thereof may be connected to first and second nodes N1 and N2, respectively. The first and second nodes N1 and N2 may be connected to the first and second resistors R1 and R2, respectively. The first and second nodes N1 and N2 may be first and second output terminals Out1 and Out2, respectively. The second resistor R2 may have the same resistance value as the first resistor R1, or may be a variable resistor set to a resistance value different to that of the first resistor R1. The first resistor R1 may compensate for a difference between resistance values of the smoke and reference sensors 10 and 20 at an initial setup operation of the smoke sensor 10. The first output terminal Out1 may be connected to the first node N1, and the second output terminal Out2 may be connected to the second node N2. The first output terminal Out1 may output a first output voltage Vout1 in response to the first smoke detection signal IN1 of the smoke sensor 10. The second output terminal Out2 may output a second output voltage Vout2 in response to the second smoke detection signal IN2 of the reference sensor 20. The first comparator 42 may provide the second comparator 44 with the first smoke level measurement signal M1 corresponding to a difference between the first and second output voltages Vout1 and Vout2.

When the first smoke detection signal IN1 of the smoke sensor 10 is similar in level to the second smoke detection signal IN2 of the reference sensor 20, the first comparator 42 may output the first smoke level measurement signal M1 having 0V to the second comparator 44. When smoke is sensed by the smoke sensor 10, that is, when the first smoke detection signal IN1 of the smoke sensor 10 is different in level to the second smoke detection signal IN2 of the reference sensor 20, the first comparator 42 may output the first smoke level measurement signal M1 having a level higher than 0V to the second comparator 44.

The current mirror type differential amplifier may provide the second comparator 44 or the first output terminal Out1 with the first smoke level measurement signal M1 corresponding to a difference between the first and second output voltages Vout1 and Vout2.

The following table 1 may indicate a current of the first output terminal Out1 measured after cigarette smoke is injected into a smoke box 19 formed of a tube having a length of about 20 centimeters and a time of about 30 seconds elapses.

TABLE 1

| | smoke sensor | | | | | |
|---|---|---|---|---|---|---|
| | before smoke inject | | after 30 seconds | | variation | |
| | Current | Temp. | Current | Temp. | Current | Temp. |
| Element 1 | 4.62 mA | 22° C. | 4.85 mA | 26° C. | +0.23 mA | +4° C. |
| Element 2 | 15.1 mA | 22° C. | 15.87 mA | 25° C. | +0.77 mA | +3° C. |
| Element 3 | 3.2 mA | 23° C. | 3.25 mA | 25° C. | +0.05 mA | +2° C. |
| Element 4 | 7.7 mA | 23° C. | 7.94 mA | 25° C. | +0.24 mA | +2° C. |

Herein, the smoke sensor 10 may include first to fourth elements that have different sensing capacities according to a type of a temperature-sensitive smoke sensor portion 22. Compared with a standby state, the first output terminal Out1 may output a current increased by about 0.05 mA to 0.77 mA when smoke is detected by the first to fourth elements. When smoke is detected by the first to fourth elements, a temperature may increase by about 2° C. to 3° C. The smoke box 19 may be a space separated from the reference sensor such that it is exposed to smoke independently.

The following table 2 may indicate a first output voltage Vout1 of the first output terminal Out1 measured after mosquito repellent incense smoke is injected into a smoke box 19 formed of a tube having a length of about 35 centimeters and a time of about 30 seconds and a time of about 60 seconds elapses, respectively.

TABLE 2

| | | smoke sensor | |
|---|---|---|---|
| | | element 1 | element 2 |
| second resistor | | 9.8 MΩ | 1.8 MΩ |
| resistance of reference sensor | | 765 kΩ | 765 kΩ |
| before smoke inject | Vout1 (standby state) | 2 mV | 10 mV |
| after smoke inject | Vout1 after 30 seconds | 86 mV | 2500 mV (2.5 V) |
| | Vout1 after 60 seconds | 2.96 V | 2.60 V |

In a smoke sensor 10 of a first element, a second resistor R2 may have a resistance value of about 9.8 MΩ, and a reference sensor 20 may have a resistance value of about 765 kΩ. In a smoke sensor 10 of a second element, a second resistor R2 may have a resistance value of about 1.8 MΩ, and a reference sensor 20 may have a resistance value of about 765 kΩ. The first comparator 42 may output a first output voltage Vout1 of about 2 mV to a first output terminal Out1 at a standby state that mosquito repellent incense smoke is not sensed by the smoke sensor 10 of the first element. The first comparator 42 may output the first output voltage Vout1 of about 86 mV after mosquito repellent incense smoke is injected and a time of about 30 seconds elapses. The first comparator 42 may output the first output voltage Vout1 of about 2.96V after mosquito repellent incense smoke is injected and a time of about 60 seconds elapses. At this time, a second output voltage Vout2 may be about 2 mV. Since excessively increased after smoke is sensed as compared with the second output voltage Vout2, the first output voltage Vout1 may correspond to a first smoke level measurement signal M1.

The first comparator 42 may output the first output voltage Vout1 of about 10 mV to the first output terminal Out1 at a standby state of a smoke sensor 10 of a second element. The first comparator 42 may output the first output voltage Vout1 of about 2.5V after mosquito repellent incense smoke is injected and a time of about 30 seconds elapses. The first comparator 42 may output the first output voltage Vout1 of about 3.6V after mosquito repellent incense smoke is injected and a time of about 60 seconds elapses. Thus, the smoke sensor 10 including a temperature-sensitive smoke sensor portion 22 may sense smoke. Also, the first comparator 42 may output the first smoke level measurement signal M1 generated from a first smoke detection signal IN1 of the smoke sensor 10 to a second comparator 44.

Figure 11:
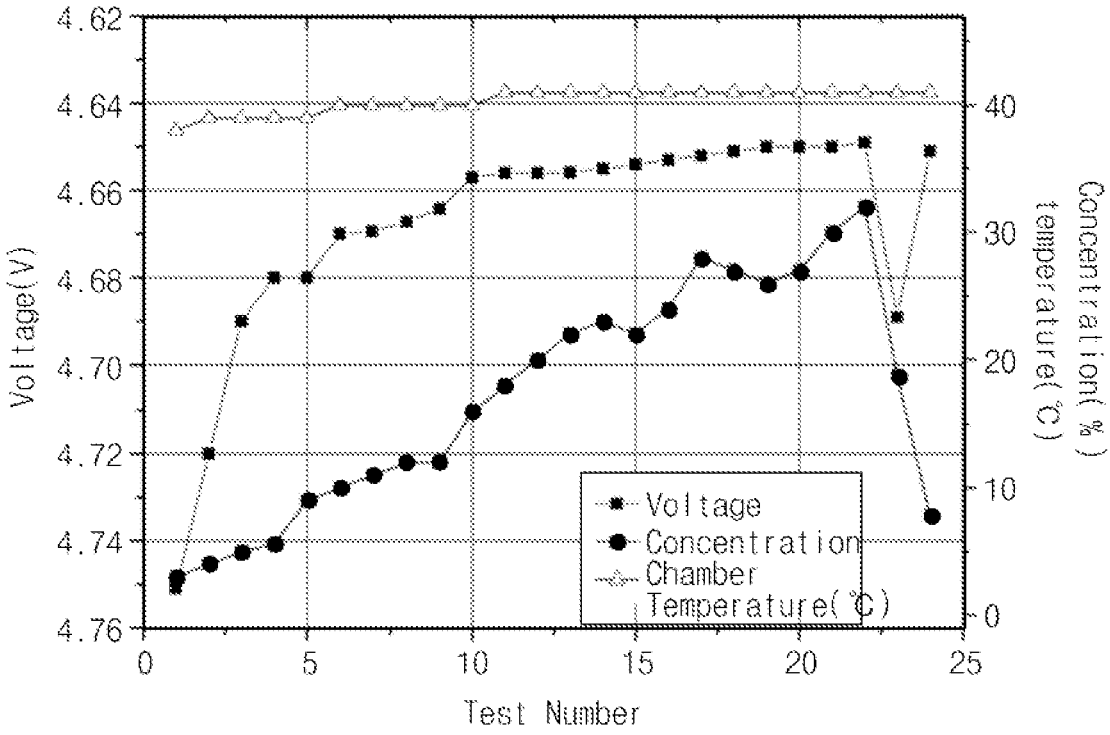
FIG. 11 is a graph indicating an output voltage of a first comparator connected with a smoke sensor.

FIG. 11 is a graph indicating an output voltage of a first comparator connected with a smoke sensor.

Referring to FIGS. 9 and 11, a first comparator 42 may output a first smoke level measurement signal M1 which is irregularly dropped in proportion to concentration of smoke sensed at a smoke sensor 10. The first comparator 42 can be formed of an amplifier from which a reference sensor 20, a second resistor R2, and a second bipolar transistor Q2 are skipped. That is, the first comparator 42 may be formed of a first bipolar transistor Q1 having a base connected to the smoke sensor 10 and a first resistor R1 connected to a collector of the first bipolar transistor Q1. In FIG. 11, a left vertical axis may indicate a voltage, a right vertical axis may indicate temperature and concentration of smoke, and a horizontal axis may indicate the number of tests executed as temperature and concentration of smoke increase. In a case where smoke is injected into a smoke box 19 of about 39° C. and 40° C. to be filled by about 2% to 3%, the first comparator 42 may output the first smoke level measurement signal M1, which decreases by about 4.75V to 4.65V, to the first output terminal Out1. At this time, if concentration of smoke increases from 2% to 5%, the first smoke level measurement signal M1 may sharply decrease from 4.75V to 4.68V. On the other hand, if concentration of smoke increases from 15% to 32%, the first smoke level measurement signal M1 may smoothly decrease from 4.6V to 4.5V. The first comparator 42 may output the first smoke level measurement signal M1 which decreases in an irregular slope according to a variation in concentration of smoke. Also, the first smoke level measurement signal M1 may mismatch with the first smoke detection signal IN1 generated from the smoke sensor 10. The reason may be that the first smoke level measurement signal M1 includes noise according to a temperature variation of the smoke sensor 10.

Figure 12:
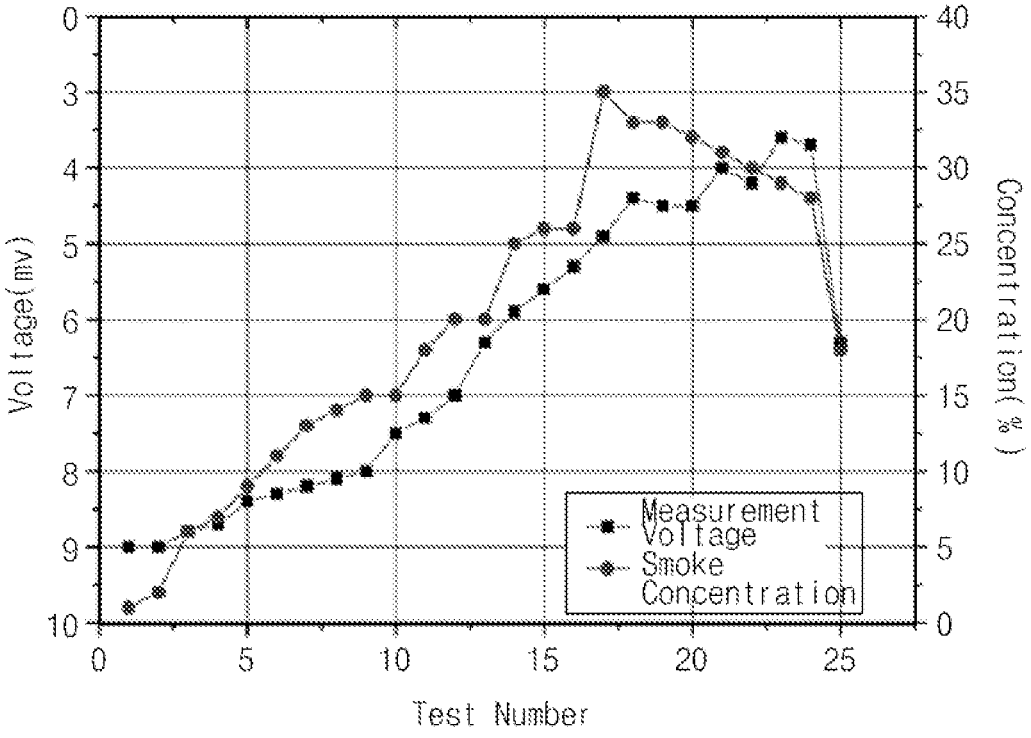
FIG. 12 is a graph indicating an output voltage of a first comparator connected with a smoke sensor and a reference sensor.

FIG. 12 is a graph indicating an output voltage of a first comparator connected with a smoke sensor and a reference sensor.

Referring to FIGS. 9 and 12, a first comparator 42 may output a first smoke level measurement signal M1 which is irregularly proportional to concentration of smoke sensed at a smoke sensor 10. In FIG. 12, a left vertical axis may indicate a voltage, a right vertical axis may indicate temperature and concentration of smoke, and a horizontal axis may indicate the number of tests executed as temperature and concentration of smoke increase. Temperatures of smoke and reference sensors 10 and 20 may increase and decrease identically. In the first comparator 42, noise due to a smoke temperature may be eliminated from a second smoke detection signal IN2 input from the reference sensor 20. For example, if smoke is injected into the smoke box 19 to be filled by about 2% to 35%, the first comparator 42 may output the first smoke level measurement signal M1 the voltage of which sequentially decreases from 9 mV to 3 mV. The first smoke level measurement signal M1 may have a slope of about 0.25. Thus, a smoke sensing unit 20 may include a reference sensor 20 having the same temperature-sensitive smoke sensor portion 22 as the smoke sensor 10 to eliminate noise corresponding to a temperature variation of the smoke sensor 10.

Referring to FIGS. 3 and 10, a cross-coupled type differential amplifier may include first and second bipolar transistors Q1 and Q2, first and second PMOS transistors PM1 and PM2, and first and second resistors R1 and R2. The smoke sensor 10 may be connected to a base of the first bipolar transistor Q1. A collector of the first bipolar transistor Q1 may be grounded, and an emitter thereof may be connected to a third node N3. The third node N3 may be connected with a drain of the first PMOS transistor PM1, a gate of the second PMOS transistor PM2, and a third output terminal Out3. A gate of the first PMOS transistor PM1 may be connected to a fourth node N4 between a drain of the second PMOS transistor PM2 and an emitter of the second bipolar transistor Q2. A source of the first PMOS transistor PM1 may be supplied with a power supply voltage Vcc through the first resistor R1. Likewise, the reference sensor 20 may be connected to a base of the second bipolar transistor Q2.

A collector of the second bipolar transistor Q2 may be grounded, and an emitter thereof may be connected to a fourth node N4. The fourth node N4 may be connected with a drain of the second PMOS transistor PM2, a gate of the first PMOS transistor PM1, and a fourth output terminal Out4. At a standby state, voltages having the same level may be output to the third and fourth output terminals Out3 and Out 4, respectively. If smoke is detected by the smoke sensor 10, voltages having different levels may be output to the third and fourth output terminals Out3 and Out 4, respectively. When smoke is detected by the smoke sensor 10, a voltage of the base of the first bipolar transistor Q1 may increase. Since a current between the collector and emitter of the first bipolar transistor Q1 increases under the condition that the first PMOS transistor PM1 is turned off, a low voltage may be output to the third output terminal Out3. Also, the second PMOS transistor PM2 may be turned on according to a voltage of the third output terminal Out3, and a voltage higher than that output to the third output terminal Out3 may be output to the fourth output terminal Out4. A difference between voltages output to the third and fourth output terminals Out3 and Out 4 may be a first smoke level measurement signal.

The second comparator 44 may compare the first smoke level measurement signal M1 with a reference signal to generate a second smoke level measurement signal M2. The second comparator 44 may include an operational amplifier. The second smoke level measurement signal M2 may provide a sensing control unit 50 with information associated with concentration of smoke.

The sensing control unit 50 may judge whether the fire breaks, using the second smoke level measurement signal M2, and may generate a fire alarm signal according to a judgment result. The sensing control unit 50 may judge concentration of smoke from the second smoke level measurement signal M2 input from the second comparator 44. A communication unit 60 may provide an alarm device or a handheld terminal in a wireless-wire manner with the fire alarm signal output from the sensing control unit 50. The sensing control unit 50 and the communication unit 60 may include a personal computer. In particular, the communication unit 60 may include at least one of a base station, a repeater, a router, and the like. The communication unit 60 may output the fire alarm signal to a handheld terminal such as a smart phone through the repeater for the user to recognize the fires.

Thus, a multipurpose alarm apparatus according to an embodiment of the inventive concept may have the higher safety than a smoke detector. Since the multipurpose alarm apparatus is cheap, the productivity may be improved or maximized.

Figure 13:
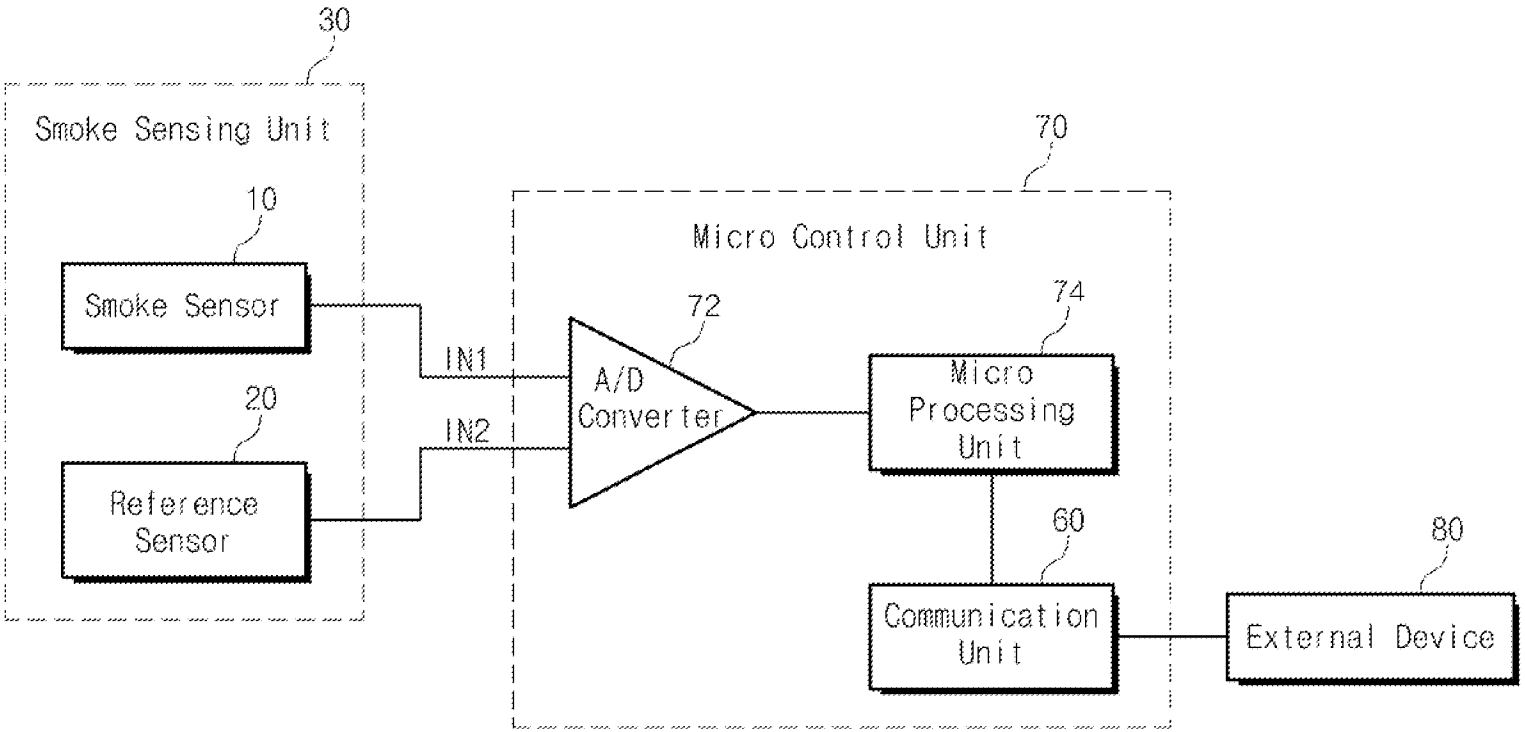
FIG. 13 is a block diagram schematically illustrating a multipurpose alarm apparatus according to another embodiment of the inventive concept.

FIG. 13 is a block diagram schematically illustrating a multipurpose alarm apparatus according to another embodiment of the inventive concept.

Referring to FIGS. 4 and 13, a multipurpose alarm apparatus according to another embodiment of the inventive concept may include a micro control unit 70 which judges the fires according to first and second smoke detection signals IN1 and IN2 from a smoke sensing unit 30 to output a fire alarm signal. The smoke sensing unit 30 may include a smoke sensor 10 and a reference sensor 20. Each of the smoke and reference sensors 10 and 20 may include a temperature-sensitive smoke sensor portion 22.

The micro control unit 70 may include an analog-to-digital converter (hereinafter, referred to as A/D converter) 72, a micro processing unit 74, and a communication unit 60. The A/D converter 72 may convert first and second analog smoke detection signals IN1 and IN2 from the smoke and reference sensors 10 and 20 into digital signals to output the digital signals to a micro processing unit 74. The A/D converter 72 may reduce noise of the first and second smoke detection signals IN1 and IN2. The A/D converter 72 may periodically sample the first and second smoke detection signals IN1 and IN2.

The micro processing unit 74 may compare and analyze the first and second smoke detection signals IN1 and IN2 to generate the fire alarm signal. Although not shown in FIG. 13, the micro processing unit 74 may include a central processing unit having registers, operators, controllers, and the like. The communication unit 60 may output the fire alarm signal from the micro processing unit 74 to an external device 80 in a wireless-wire manner.

It is possible to manufacture a micro multipurpose alarm apparatus using the micro control unit 70.

Figure 14:
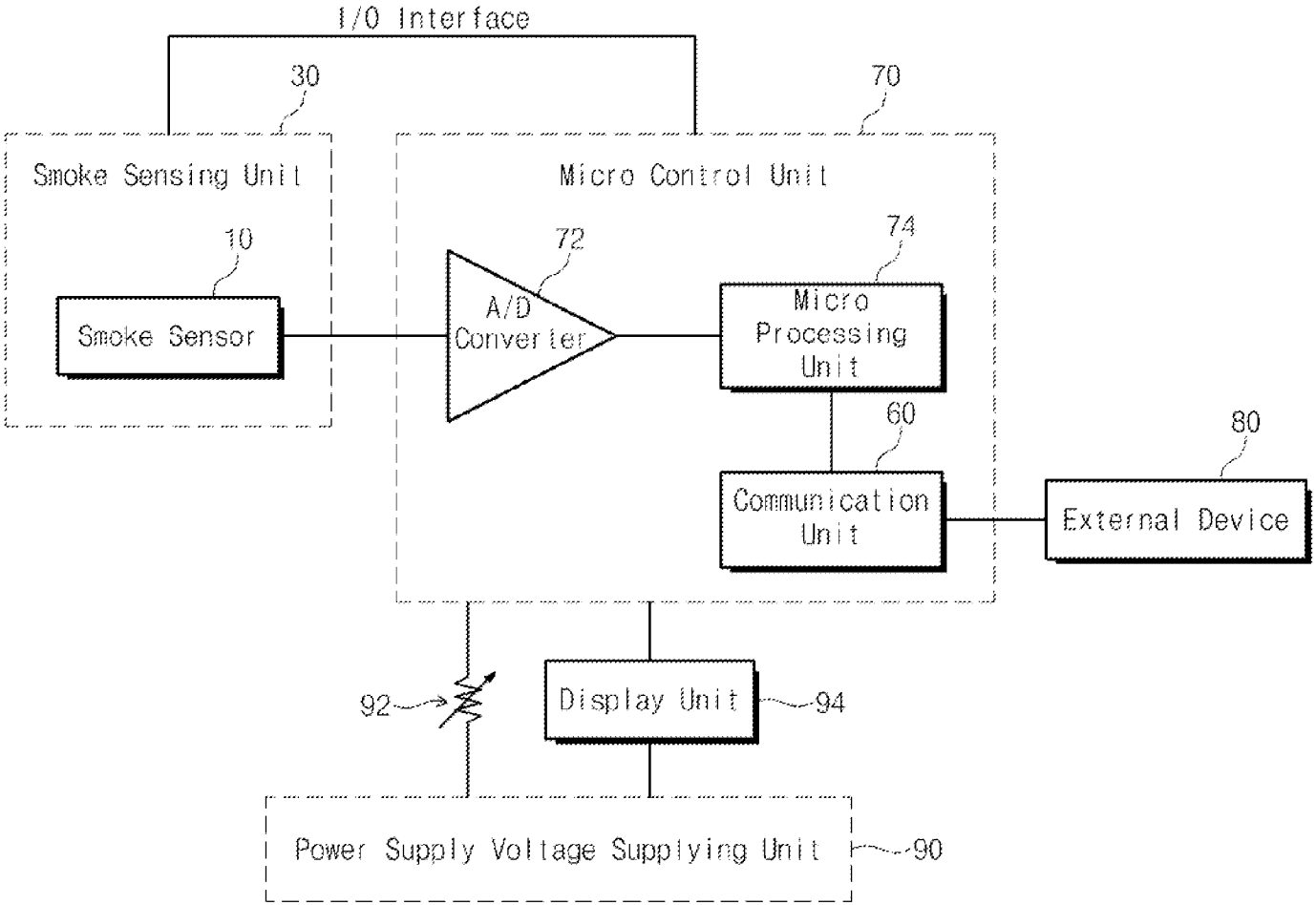
FIG. 14 is a block diagram schematically illustrating a multipurpose alarm apparatus according to still another embodiment of the inventive concept.
Figure 15:
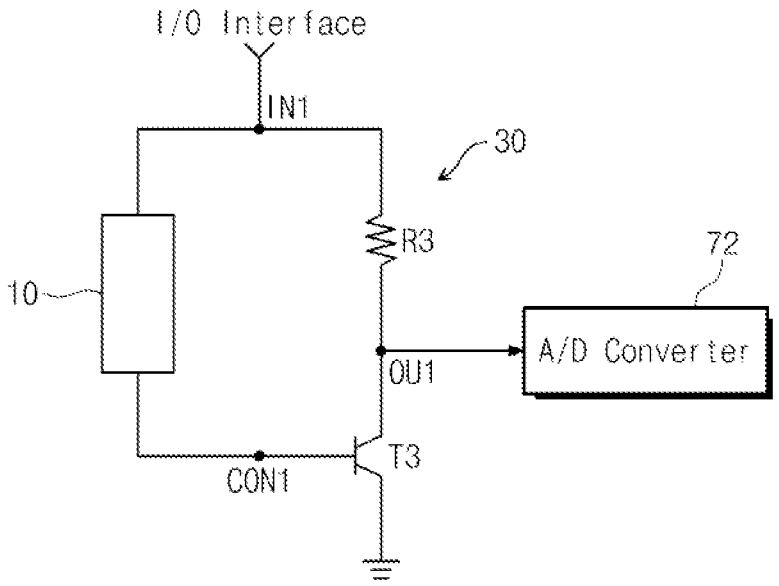
FIGS. 15 to 17 are diagrams illustrating a smoke sensing unit according to embodiments of the inventive concept.
Figure 16:
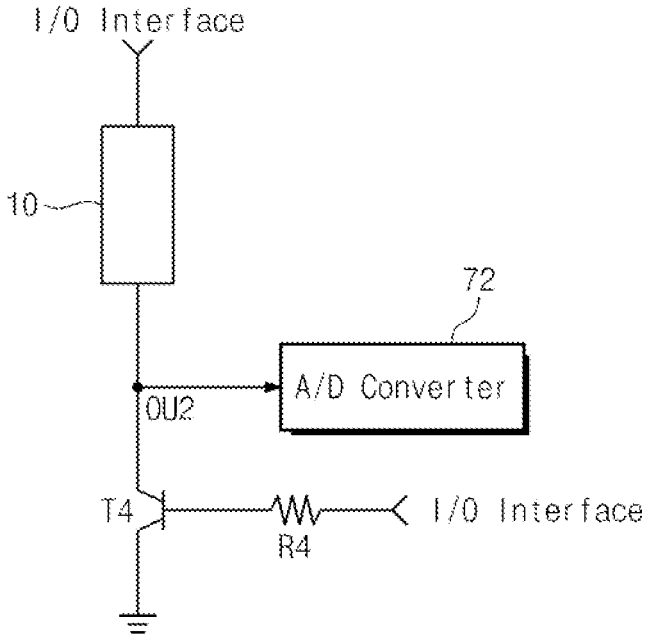
Figure 17:
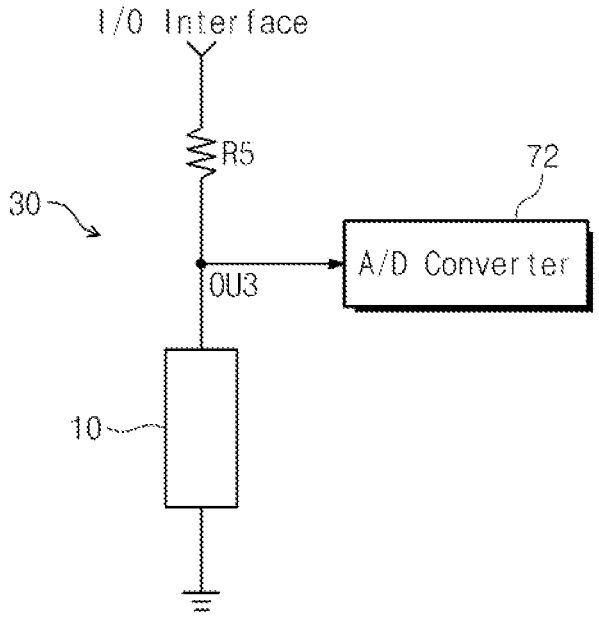
Figure 18:
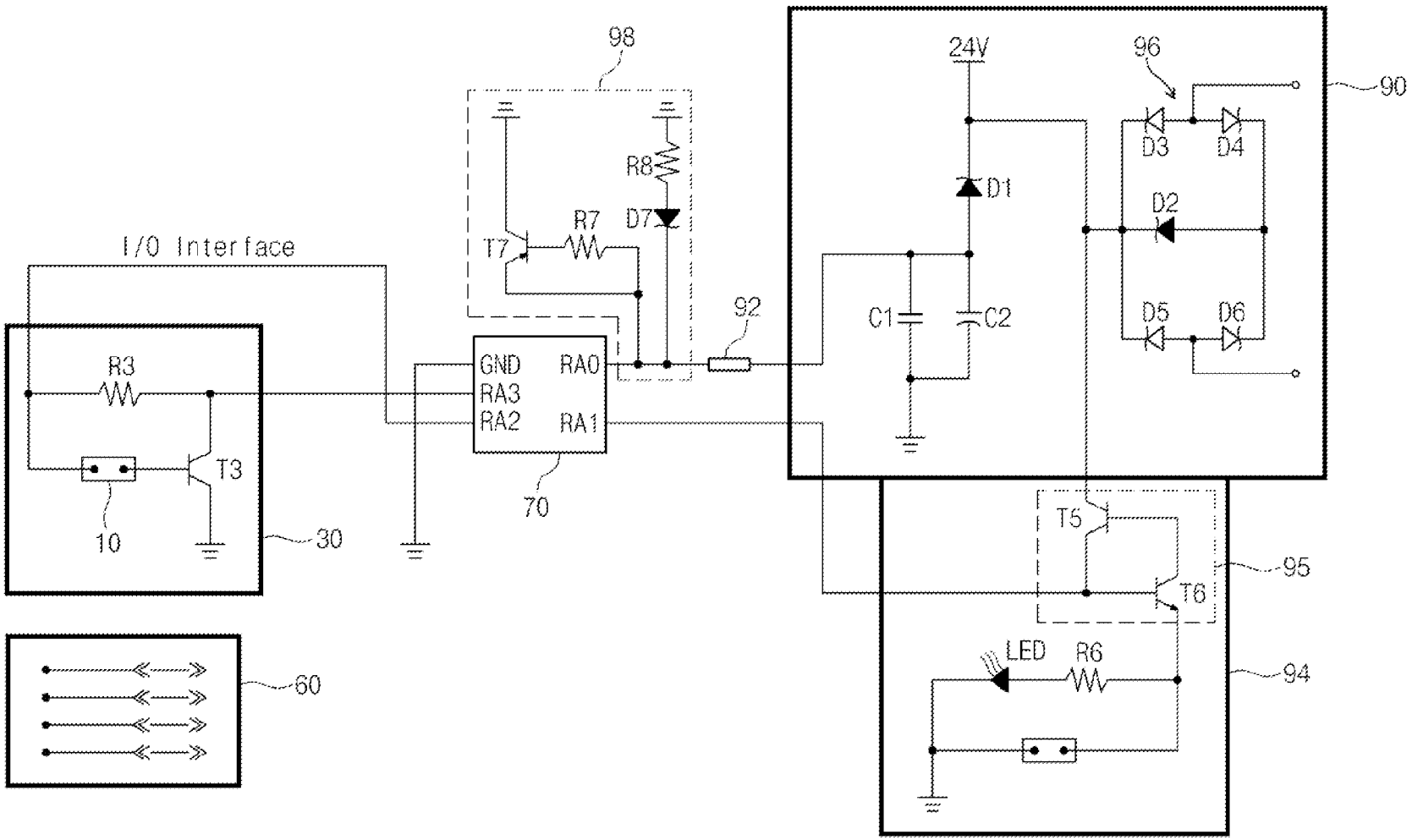
FIG. 18 is a circuit diagram of a multipurpose alarm apparatus in FIG. 14.

FIG. 14 is a block diagram schematically illustrating a multipurpose alarm apparatus according to still another embodiment of the inventive concept. FIGS. 15 to 17 are diagrams illustrating a smoke sensing unit according to embodiments of the inventive concept. FIG. 18 is a circuit diagram of a multipurpose alarm apparatus in FIG. 14.

Referring to FIGS. 4 and 14 to 18, a multipurpose alarm apparatus according to still another embodiment of the inventive concept may include a smoke sensor 10 which has a temperature-sensitive smoke sensor portion 22 formed between first and second electrodes 16 and 18 spaced apart from each other. The temperature-sensitive smoke sensor portion 22 may include a metal-insulator transition material the resistance value of which varies at a predetermined temperature. Although not shown in figures, the smoke sensor 10 may include a PNP or NPN bipolar transistor having a collector and an emitter corresponding to the first and second electrodes 16 and 18, respectively. A smoke sensing unit 30 may detect a temperature of a power element of a power system as well as smoke. The power element may include a power transistor or a power LED. A micro control unit 70 may output a control signal for controlling heat of the power element. Below, the smoke sensing unit 30 including one smoke sensor 10 will be more fully described.

Referring to FIG. 15, the smoke sensing unit 30 may vary a sensing output level of a voltage drop output terminal OU1 connected with a sensor input bias IN1 using an output of a sensor 10. For example, the smoke sensing unit 30 may include a third resistor R3 connected in parallel with the smoke sensor 10 and a third bipolar transistor T3 for amplifying a smoke detection signal of the smoke sensor 10. The third resistor R3 may be connected between the sensor input bias IN1 and the voltage drop output terminal OU1. The smoke sensor 10 may be connected to a base of the third bipolar transistor T3. The smoke sensor 10 and the third resistor R3 may be connected in parallel to an I/O interface. That is, the smoke sensor 10 may be connected between the I/O interface and the base of the third bipolar transistor T3, and the third resistor R3 may be connected between the I/O interface and an input of an A/D converter 72. The emitter of the third bipolar transistor T3 may be connected to the voltage drop output terminal OU1, a collector thereof may be grounded, and a base thereof may be connected to an output terminal CON1 of the smoke sensor 10. The third resistor R3 may be load on the emitter of the third bipolar transistor T3. When a smoke detection signal is generated from the smoke sensor 10, an amplified current may flow from the collector of the third bipolar transistor to the emitter thereof.

Referring to FIG. 16, the smoke sensor 10 may be connected between the I/O interface and the A/D converter 72. At this time, an output level of the smoke sensor 10 may correspond to a detection output level. Also, an output level of the smoke sensor 10 may be adjusted responsive to an input signal of another I/O interface. For example, the smoke sensing unit 30 may include a fourth bipolar transistor T4 which has an emitter connected to an output terminal OU2 of the smoke sensor 10, an emitter grounded, and a base connected to an I/O interface via a fourth resistor R4.

Referring to FIG. 17, the smoke sensing unit 30 may be configured such that a detection output level of a voltage drop output terminal OU3 connected to an input bias of the smoke sensor 10 is dependent upon the sensitivity of a detection operation. For example, the smoke sensing unit 30 may include a fifth resistor R5 connected between an I/O interface connected from a power supply voltage supplying unit 90 and a ground voltage and a smoke sensor 10. The fifth resistor R5 may be a load of the smoke sensor 10, and may minimize a standby current. The smoke sensor 10 may act as a variable resistor which varies with respect to a constant resistance value of the fifth resistor R5. The A/D converter 72 may be connected between the fifth resistor R5 and the smoke sensor 10.

Thus, the multipurpose alarm apparatus (or, referred to as a temperature-smoke complex alarm apparatus) may be configured to include a smoke sensing unit 30 formed of one smoke sensor 10.

Referring to FIGS. 14 and 18, a micro control unit 70 may generate a reference signal from a smoke detection signal output from a smoke sensor 10 at a wait/standby state. The smoke detection signal output from the smoke sensor 10 may have different peak levels according to a normal standby state and a smoke generation state. The micro control unit 70 may recognize a smoke detection signal as a reference signal at a standby state of the smoke sensor 10. In response to a smoke detection signal having a level higher than that at a standby state, the micro control unit 70 may output a smoke generation signal to an external device 80 via a communication unit 60.

Thus, a multipurpose alarm apparatus (or, referred to as a temperature-smoke complex alarm apparatus) may include a smoke sensing unit 30 which is formed of one smoke sensor 10 without a reference sensor 20.

A power supply voltage supplying unit 90 may power the micro control unit 70 and the smoke sensing unit 30. The power supply voltage supplying unit 90 may include a first diode D1 for providing a DC constant voltage; first and second capacitors C1 and C2; and a bridge diode circuit 96 for converting an AC voltage into a DC voltage. The bridge diode circuit 96 may include a zener diode D2 and a plurality of diodes D3, D4, D5, and D6. The zener diode D2 may lower an external supply voltage which is higher than a required voltage of the micro control unit 70. Although not shown in figures, the power supply voltage supplying unit 90 may further include a variable transformer. For example, the power supply voltage supplying unit 90 may receive an external input voltage of about 24V to supply an output voltage of about 3V to the micro control unit 70.

The micro control unit 70 and the smoke sensor 10 may be connected by an I/O interface. The micro control unit 70 may receive a power supply voltage from the power supply voltage supplying unit 90. The I/O interface may be connected between the micro control unit 70 and the smoke sensor 30. The micro control unit 70 may input a bias voltage to the smoke sensing unit 30 through the I/O interface.

Referring to FIGS. 4 and 18, a power supply voltage switch unit 92 for switching a power supply voltage may be connected between the micro control unit 70 and the power supply voltage supplying unit 90. The power supply voltage switch unit 92 may include a temperature sensor for turning on a power supply voltage over a specific temperature. The temperature sensor may include a metal-insulator transition material. As described above, the metal-insulator transition material may be disposed between a first electrode 16 and a second electrode 18. The metal-insulator transition material may turn on a power supply voltage between the first electrode 16 and the second electrode 18 over a specific temperature. For this reason, the power supply voltage switch unit 92 may remove consumption of a standby power.

A constant voltage and noise removing circuit 98 may be disposed between the power supply voltage switch unit 92 and the micro control unit 70. The constant voltage and noise removing circuit 98 may include a bipolar transistor T7, a resistor R7, a zener diode D7, and a resistor R8. An emitter of the bipolar transistor T7 may be connected to the power supply voltage switch unit 92, and a collector thereof may be grounded.

The power supply voltage supplying unit 90 may include a display unit 94 which displays a supply state of a power supply voltage. The display unit 94 may display an operating state such as a turn-on or turn-off state of the power supply voltage switch unit 92. The display unit 94 may include transistors T4 and T5, a resistor R5, and a light emitting diode LED. The transistors T4 and T5 may include a thyristor or a thyristor equivalent circuit for keeping a current when controlled by the micro control unit 70. The light emitting diode LED may emit light when the power supply voltage switch unit 92 is turned on. The communication unit 60 may perform wireless-wire communication with an external device 80. In particular, the communication unit 60 may perform communication with a mobile phone such as a smart phone or an iPhone.

Thus, a multipurpose alarm apparatus (or, referred to as a temperature-smoke complex alarm apparatus) may improve the safety and productivity.

While the inventive concept has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A multipurpose alarm apparatus comprising:

a smoke sensing unit configured to sense a smoke using a first sensor and a second sensor, each of the first and second sensors including a temperature-sensitive smoke sensor portion disposed between a first electrode and a second electrode;

a smoke level measuring unit configured to generate a smoke level measurement signal by comparing a difference between first and second smoke detection signals from the first and second sensors with a reference signal; and a sensing control unit configured to generate a fire alarm signal when the smoke level measurement signal corresponds to a fire generation condition.

2. The multipurpose alarm apparatus of claim 1, wherein the temperature-sensitive smoke sensor portion includes a metal-insulator transition material.

3. The multipurpose alarm apparatus of claim 1, wherein the first sensor include a can type package having an opening hole formed to expose the temperature-sensitive smoke sensor portion to the smoke.

4. The multipurpose alarm apparatus of claim 1, wherein the second sensor includes a mold type package configured to seal the temperature-sensitive smoke sensor portion.

5. The multipurpose alarm apparatus of claim 1, wherein the smoke level measuring unit includes a differential amplifier configured to amplify a difference between the first smoke detection signal and the second smoke detection signal.

6. The multipurpose alarm apparatus of claim 5, wherein the differential amplifier is a current mirror type or a cross coupled type.

7. A multipurpose alarm apparatus comprising:

a smoke sensing unit including a sensor having a temperature-sensitive smoke sensor portion disposed between a first electrode and a second electrode; and a micro control unit configured to generate a fire alarm signal using a smoke detection signal output from the sensor to output the fire alarm signal to an external device, wherein the temperature-sensitive smoke sensor portion includes a metal-insulator transition material having a resistance value that decreases according to an increase in a temperature.

8. The multipurpose alarm apparatus of claim 7, wherein the metal-insulator transition material includes vanadium oxide.

9. The multipurpose alarm apparatus of claim 7, wherein the sensor includes an NPN or PNP bipolar transistor having a collector and an emitter corresponding to the first electrode and the second electrode, respectively.

10. The multipurpose alarm apparatus of claim 7, wherein the sensor includes a cap type package having an opening hole formed to expose the temperature-sensitive smoke sensor portion.

11. The multipurpose alarm apparatus of claim 7, wherein the sensor includes a mold type package formed to seal the temperature-sensitive smoke sensor portion.

12. The multipurpose alarm apparatus of claim 11, wherein the mold type package includes a clear compound not chemically reacting to the temperature-sensitive smoke sensor portion.

13. The multipurpose alarm apparatus of claim 7, further comprising:

a power supply voltage supplying unit configured to supply a power supply voltage to the smoke sensing unit and the micro control unit.

14. The multipurpose alarm apparatus of claim 13, further comprising:

an input/output interface connected between the smoke sensing unit and the micro control unit.

15. The multipurpose alarm apparatus of claim 14, wherein the smoke sensing unit is configured to vary a detection output level of a voltage drop output terminal connected to a sensor input bias using an output of the sensor.

16. The multipurpose alarm apparatus of claim 15, wherein the smoke sensing unit includes a resistor connected between the sensor input bias and the voltage drop output terminal.

17. The multipurpose alarm apparatus of claim 15, wherein the smoke sensing unit comprises a first transistor connected between the voltage drop output terminal and an output terminal of the sensor.

18. The multipurpose alarm apparatus of claim 14, wherein the smoke sensing unit is configured such that an output level of the sensor corresponds to a detection output level and an output level of the sensor is adjusted responsive to an input of the input/output interface.

19. The multipurpose alarm apparatus of claim 18, wherein the smoke sensing unit includes a second transistor connected between the output terminal of the sensor and a ground and controlled by an input of the input/output interface.

20. The multipurpose alarm apparatus of claim 14, wherein the smoke sensing unit is configured such that a detection output level of a voltage drop output terminal connected to a sensor input bias is dependent upon a sensitivity of a sensing operation of the sensor.

21. The multipurpose alarm apparatus of claim 13, wherein the power supply voltage supplying unit includes a zener diode for lowering a voltage to a required voltage of the micro control unit.

22. The multipurpose alarm apparatus of claim 13, wherein the power supply voltage supplying unit further comprises a bridge diode circuit.

23. The multipurpose alarm apparatus of claim 13, wherein the power supply voltage supplying unit includes a thyristor or a thyristor equivalent circuit for keeping a current controlled by the micro control unit.

24. The multipurpose alarm apparatus of claim 7, wherein the micro control unit further comprises a communication unit transmitting the fire alarm signal to an external device.

25. The multipurpose alarm apparatus of claim 24, wherein the communication unit includes at least one of a base station, a repeater, or a router.

26. The multipurpose alarm apparatus of claim 25, wherein the communication unit further comprises a handheld terminal.

27. The multipurpose alarm apparatus of claim 7, wherein the smoke sensing unit detects an electromagnetic wave of an infrared ray.

28. The multipurpose alarm apparatus of claim 7, wherein the smoke sensing unit detects a temperature of a power element of a power system.

29. The multipurpose alarm apparatus of claim 28, wherein the micro control unit controls a heat of the power element.

* * * * *